United States Patent [19]

Carden

[11] 4,445,024

[45] Apr. 24, 1984

[54] ELECTRIC KILN

[75] Inventor: Peter O. Carden, Canberra, Australia

[73] Assignee: Research Technology Canberra Pty. Ltd., Canberra, Australia

[21] Appl. No.: 358,596

[22] Filed: Mar. 16, 1982

[30] Foreign Application Priority Data

Mar. 24, 1981 [AU] Australia ..... PE8091

[51] Int. Cl.[3] ..... F27B 5/14; F27D 11/00

[52] U.S. Cl. ..... 219/390; 219/385; 219/406; 219/408; 219/536; 338/305; 338/316; 373/130; 373/134

[58] Field of Search ..... 219/347, 316, 385, 390, 219/406, 407, 408, 409, 536, 535; 373/111, 119, 127, 130, 134, 137; 338/294, 295, 305, 316

[56] References Cited

U.S. PATENT DOCUMENTS

| | | | |
|---|---|---|---|
| 724,069 | 3/1903 | Winter | 219/406 |
| 1,119,838 | 12/1914 | Kuhn | 338/305 X |
| 1,247,286 | 11/1917 | Kuhn et al. | 338/305 X |
| 1,649,925 | 11/1927 | Ruckstahl | 373/130 |
| 1,959,358 | 5/1934 | Gouverneur | 219/406 |
| 3,109,082 | 10/1963 | Polaniecki | 219/390 X |
| 3,189,726 | 6/1965 | Vary | 219/347 |
| 3,350,493 | 10/1967 | Randall | 373/119 |
| 3,361,863 | 1/1968 | Lang | 219/390 X |
| 3,384,852 | 5/1968 | Beck et al. | 338/316 |
| 3,406,275 | 10/1968 | Perdrotti | 219/406 |
| 3,409,727 | 11/1968 | Hampton | 373/134 |
| 3,429,034 | 2/1969 | Burdge et al. | 338/316 |
| 3,705,253 | 12/1979 | Hicks | 219/390 X |
| 3,786,162 | 1/1974 | Colson | 219/316 X |
| 3,786,164 | 1/1974 | Hintenberger | 219/390 |
| 3,860,738 | 1/1975 | Hintenberger | 219/406 X |

FOREIGN PATENT DOCUMENTS

| | | | |
|---|---|---|---|
| 503735 | 8/1930 | Fed. Rep. of Germany | 338/305 |
| 331793 | 7/1930 | United Kingdom | 219/406 |

*Primary Examiner*—Volodymyr Y. Mayewsky

*Attorney, Agent, or Firm*—Fleit, Jacobson, Cohn & Price

[57] ABSTRACT

This invention relates to a new type of electric kiln suitable for the firing of pottery in small batches as is customarily carried out by hobbyists. In its preferred form the invention comprises an upright cylindrical wall of ceramic fibre thermal insulation mounted on a thermally insulating base and fitted with a lid of similar insulating material. Located within the cylindrical wall is a heating element which is a single multiturn helix of resistance wire of helix diameter slightly smaller than the inner diameter of the cylindrical wall. The diameter of the resistance wire may be substantially greater (and the electrical resistance less) than is normally used in electric kilns of similar size thus permitting a greater tolerance to corrosion.

The heating element is carried in a set of equispaced ceramic pillars which permit changes in the diameter of the helix while maintaining the separation of the turns of the helix.

Matching to a source of alternating current is achieved by an electronic circuit which permits variable transformations of the voltage and current.

8 Claims, 6 Drawing Figures

Fig. 2a
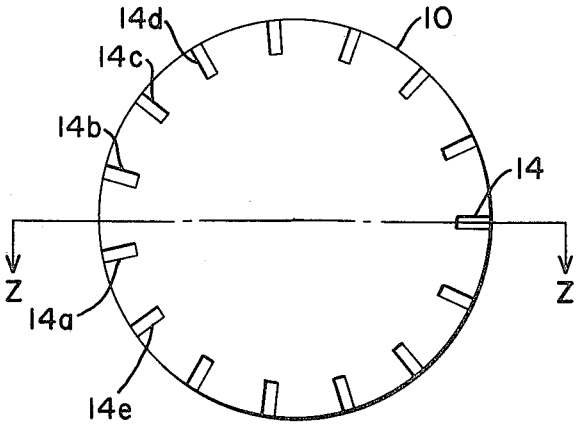
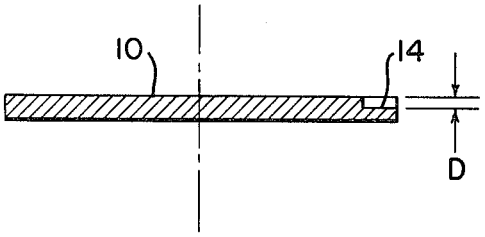
Fig. 2b

ELECTRIC KILN

FIELD OF THE INVENTION

This invention relates to an improved electric kiln especially suitable for earthenware or stoneware pottery.

This invention is most relevant to small kilns suitable for use by hobbyists although it is not restricted to this class of kiln.

DESCRIPTION OF THE PRIOR ART

Robert Fournier ("Electric kiln construction for potters". Van Nostrand Reinhold, N.Y. 1977) and Harry Fraser ("Electric kilns". (Sarah Bodine ed.) Watson-Guptill, N.Y. 1974) in describing the present state of art mention that insulants include various bricks and advanced lightweight materials including ceramic wool and derivatives made by the addition of hardeners or rigidisers (an example of an inorganic hardener is colloidal silica).

Electric elements are constructed of special wire or strip, as well known material being Kanthal Al which the manufacturers state is suitable for temperatures to 1350 C. under certain conditions. More expensive higher temperature elements are available e.g. silicon-carbide.

Wire elements are formed into continuous spirals of diameter about 5 times the wire diameter as recommended by the manufacturers e.g. see "The Kanthal handbook", Bulten-Kanthal A. B., Hallstahammar, Sweden. The spirals are then placed in horizontal grooves cut in the inner face of the kiln wall. This method evolved with and is suitable for brick insulants. The lighter materials such as ceramic wool are less suitable as they are less able to withstand the structural weakness brought about by the grooving and the stress due to the weight of the elements. Nevertheless Fournier describes vacuum formed grooved ceramic fibre wall slabs. At least one manufacturer employs ceramic shelves embedded in the wool.

Frank A. Colson ("Kiln building with space-age materials". Van Nostrand Reinhold, N.Y. 1974) describes a cylindrical kiln (U.S. Pat. No. 3,786,162) which may be disassembled and is made of cast ceramic fibre suitable for electric or gas firing. When electrically heated the elements are contained in recesses cast in the inner wall of the kiln. Colson also describes a kiln produced by Lindberg Industries U.S.A. where performed heating wires (presumably spiralled) are moulded into the ceramic fibre walls of a kiln.

The practice of spiralling overcomes the problem of thermal expansion. However for the size of kiln suitable for hobbyists there is a practical limit to the thickness of wire that can be formed into spirals. In practice wire size in spirals is limited to about 1 mm.

There is an advantage in using thicker wire if the kiln is intended to operate at stoneware temperatures—e.g. Kanthal Pty. Ltd. recommends a minimum of 3 mm. wire diameter for operating temperatures of 1350 C. Thick wire (approx. 3 mm or more) is structurally superior and much less prone to surface corrosion than thin wire (approx. 1 mm or less).

Another relevant aspect of the state of the art is the matching of the resistance of the heating wire to the electrical source. A well matched circuit is one in which the current drawn is equal to the maximum permitted by the supply authority and is a desirable feature when optimum use is required from a given source of electrical power to achieve a desired kiln temperature. Direct connection to the supply authority's main is preferred in order to avoid the expense of providing a transformer. However this requirement restricts the wire sizes and element configurations available to the designer. For example matching for maximum permissible power to the standard general purpose outlet in Australia requires the element to have an operating resistance of 24 ohms.

Control of electrical power for a kiln is normally governed by mechanical on-off switches. These may switch on and off automatically according to a prescribed duty cycle in order to control the average power being supplied to the kiln. Alternatively an on-off switch may be operated by a thermostat mechanism.

Where power transformers are used to maintain matching, they must be fitted with tappings in cases where the supply voltage or element resistance or both are subject to change.

Electronic methods for chopping the supply alternating voltage wave form are also used for control. These methods are normally unable to effect matching. Tapped transformers may also be used for power control.

SUMMARY OF THE INVENTION

The alternative arrangement for a heating wire element in a cylindrical kiln viz., a helix of helix diameter comparable to the internal diameter of the kiln, does not appear to have been considered by any manufacturer. This arrangement would not be suitable for moulding into the kiln wall because thermal expansion of the helix would be inhibited and would therefore result in buckling of the wire.

It is an object of this invention to enable the use of thick heating wire and thus overcome the present limitations to life and maximum operating temperature imposed by the use of thin wire. The present use of thin wire appears to be directly related to the need for matching and the practice of spiralling.

In addition the use of thick heating wire will make practical electric kilns embodying facilities to introduce gaseous atmospheres other than oxidising atmospheres. This is because thick wire has a greater resistance to the effects of the surface corrosion than thin wire.

A second objective of this invention is to overcome the problem of thermal expansion in helical wire elements of helix diameter approaching the internal diameter of the cylindrical wall of the kiln.

A third objective of this invention is to overcome the matching problem by incorporation of a special circuit whose operation is described herein and which avoids the use of a power transformer and enables accurate matching notwithstanding changes in supply voltage and resistance of the heating element.

Thus in a broad sense this invention provides an electric kiln comprising a heating chamber having an access door thereto, a heating element formed as a continuous length from unspiralled wire, said element shaped to form a plurality of sequential, spaced turns, the arrangement being such that each of the turns approximate the contour of the internal wall surface of said chamber adjacent thereto, said turns being supported whereby the wire forming the element is able to move towards and away from said respective wall surfaces to accommodate strain brought about by operational effects.

BRIEF DESCRIPTION OF THE SEVERAL VIEWS OF THE DRAWINGS

FIG. 2*a* is a plan view of ceramic disc 10 viewed separately.

FIG. 2*b* is a cross-sectional elevation of the ceramic disc 10 of FIG. 2*a* taken along line 2—2 thereof.

DETAILED DESCRIPTION

Figure 1A:
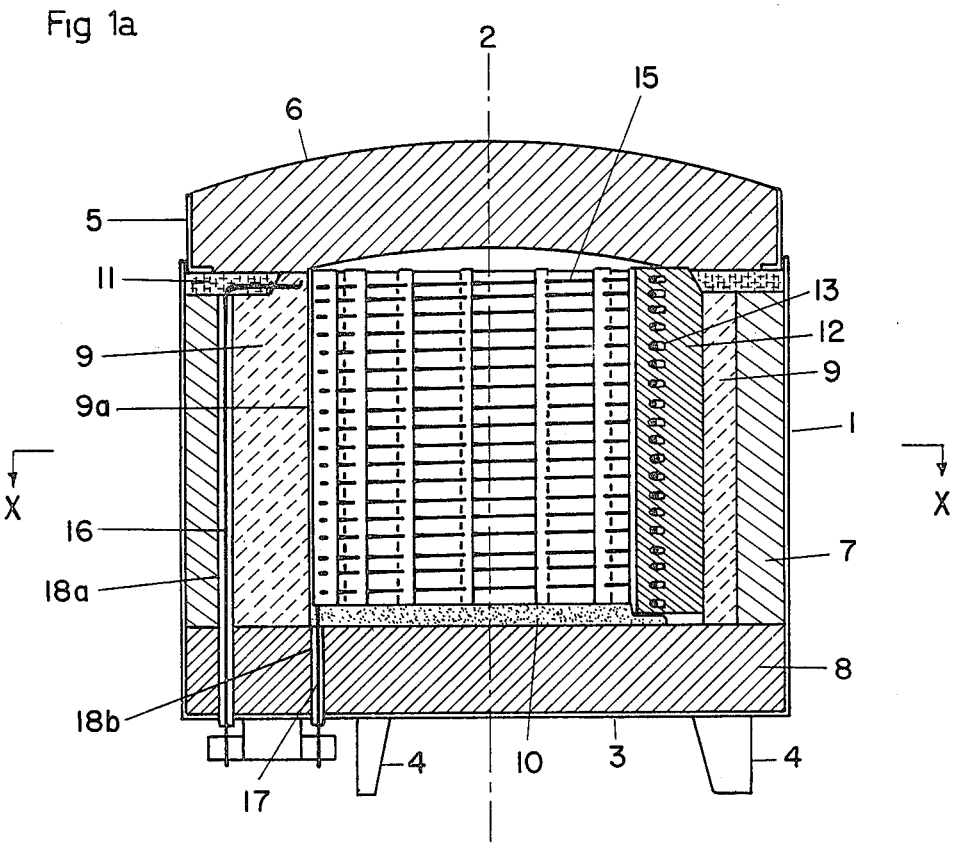
FIG. 1*a* is a cross-sectional elevation of a preferred kiln of the invention.
Figure 1B:
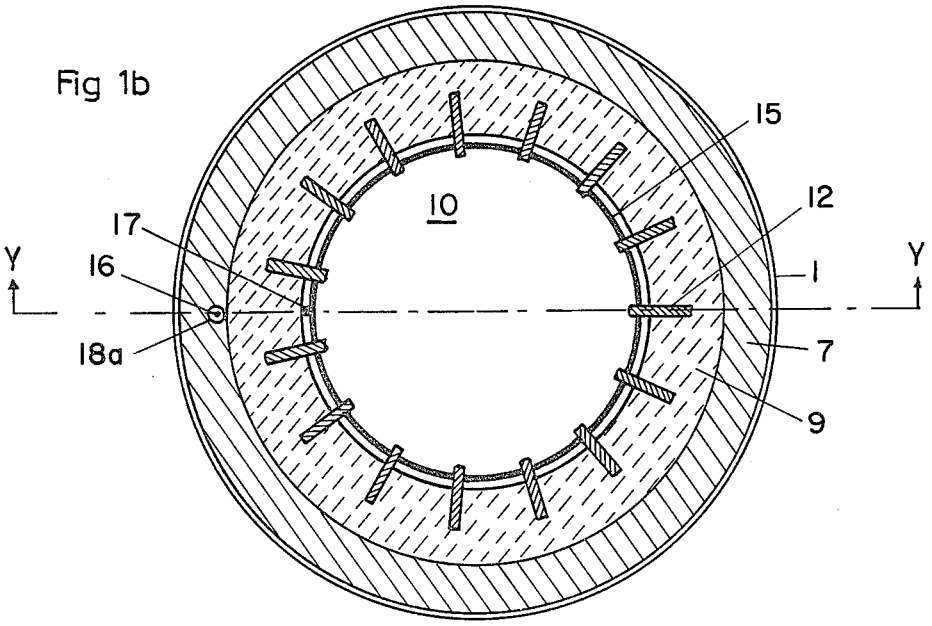
FIG. 1*b* is a cross-sectional plan of the kiln of FIG. 1*a*.

Now having regard to the figures, 1 is a cylindrical metal container with axis 2. Attached to container 1 is metal base 3 and legs 4. Located within the rim of container 1 is a removable access door comprising cylindrical metal door frame element 5 and thermally insulating material 6. Container 1, base 3, legs 4 and door frame element 5 together constitute a frame which contains and supports a heating chamber comprising components 7, 8, 9, 6, 10 and 11. Component 7 is a cylindrical layer of ceramic wool. Component 8 is a disc-shaped ceramic wool base. Component 9 is an insert of basically cylindrical shape made of ceramic wool treated with a hardener such as colloidal silica. Surface 9*a* is the cylindrical wall of the kiln. Material 6 is conveniently made wholly or partially of ceramic wool treated with hardener. Component 10 is a ceramic disc having a set of radially oriented slots near its edge. Component 11 is a layer of relatively soft ceramic wool intended to accommodate deformation due to shrinkage of the ceramic wool in the components of the heating chamber during service. Thus the access door is intended to bear on the top of the hardened insert 9 where it is shown contiguous with material 6 in FIG. 1*a*.

Formed in the hardened material of insert 9 are a number of equispaced vertical grooves (e.g. 15) of a size to accommodate vertical pillars 12. Each pillar 12 is made of hardened ceramic wool or other suitable electrically insulating material, shaped in the form of a rectangular strip or slab with a vertical row of equispaced elongated holes 13. The pillars 12 are identical to one another with regard to the positions of these holes within each pillar. Each pillar fits in a slot such as 14 in the edge of ceramic disc 10, the slot serving as a means of locating the lower end of the pillar. Thus, with the action of gravity, each pillar is completely located and held in position in the grooves in insert 9 and slots in disc 10. The depth of a typical slot 14 shown by dimension D in FIG. 2*b* therefore determines the height of all the holes 13 in the pillar located in the slot.

The depths of the slots in disc 10 are all different as is shown in FIG. 2*b*. As one proceeds in a certain direction, either clockwise or anticlockwise when viewed from above, around the edge of the disc 10, commencing with the shallowest slot 14*a*, the depths of successive slots such as 14*b*, 14*c* and 14*d*, increase by equal increments until the deepest slot 14*e* is reached which is located adjacent to the shallowest slot 14*a*. The incremental increase in depth equals the vertical spacing of holes 13 divided by the number of pillars 12.

Carried in the holes 13 is an electric heating element made from unspiralled heavy gauge resistive wire. The thickness of the wire is further discussed in later paragraphs of this specification. The electric heating element is formed into a helical section 15 and relatively short terminal sections 16 and 17. The hand of the helical section (right hand or left hand) corresponds to the certain direction (clockwise or anticlockwise) referred to above in relation to the depths of the slots in disc 10 in that where the certain direction is clockwise the hand is right and where the certain direction is anticlockwise the hand is left.

In the manufacturing process the whole of the element is first set into the shape of a wire helix by bending it around a cylindrical former of diameter appropriately less than the required diameter of the wire helix to allow for spring-back after removal from the former. Pillars 12 are held in a jig while the wire helix is screwed through the holes 13. The ends of the wire helix are then bent to form the terminal sections 16 and 17, the remaining wire constituting helical section 15. The sub-assembly of helical section 15, terminal sections 16 and 17, and pillars 12 is taken from the jig and inserted as a unit into the cylindrical insert 9 the pillars 12 entering the top of the appropriate grooves in cylindrical insert 9 and sliding down.

The terminal sections 16 and 17 at the same time slide down ceramic tubes 18*a* and 18*b*. (These tubes may be made of wool treated with hardener and temporarily lined with plastic tubing to facilitate threading of the terminal sections).

The electric heating element should be thick enough to enable it to substantially retain its curvature after formation of the wire helix and while subsequently being acted upon by random perturbing forces as might occur during the screwing process. It has been found that an adequate measure of the extreme values of these perturbing forces is that they are not great enough to stress the material of the wire beyond the elastic limit at an ambient temperature. Typically this criterion gives the formula $$d \geqq D/K$$

where d is the wire thickness (in the radial direction of the helix for wire with a non-circular cross section), D the helix diameter and K approximately 100 for Kanthal Al wire.

It is to be noted that retention of the helical shape per se after the wire helix has been formed is not a requirement, i.e., individual turns need not remain substantially coaxial with one another nor at any particular pitch.

Pillars 12 may be conveniently made by drilling and filling the holes 13 in 5 mm thick vacuum formed ceramic wool board treated afterwards with inorganic hardener. Each hole 13 is of the shape illustrated in FIG. 3. Diameter d is made larger than the wire diameter (at least 25% larger is recommended). Distance 1 is equal to the radius of the helix multiplied by the operating temperature range of the wire multiplied by the average coefficient of expansion for this range multiplied by a factor to allow for grain growth of the wire. This factor is recommended to be 1.5 or greater.

Figure 3:
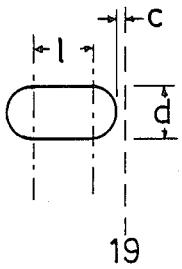
FIG. 3 is a diagrammatic representation of a preferred detail of the invention.

Line 19 in FIG. 3 represents the position of the cylindrical wall of insert 9, i.e. 9*a*, in relation to the holes 13. Distance c is recommended to be zero but may be a few millimeters.

The invention may include additional features common to the state of the art. For example a pyrometer is most easily accommodated in the access door. A spy hole may be placed in the access door or through the side of the kiln. In the latter case, in order to avoid one or more turns of the helical section of the heating element from obstructing the view through the spy hole it is preferable to introduce a transition at one level in the helical section by distorting one turn so as to appropriately increase the spacing between the two adjacent turns which will subsequently lie on either side of the spy hole. To implement this transition the regular spacing of holes 13 must be interrupted at an appropriate location on each pillar and any convenient method may be employed for achieving this. The screwing procedure referred to earlier need not be affected by the presence of these interruptions in the pillars provided the transition is smooth over the turn involved.

Figure 4:
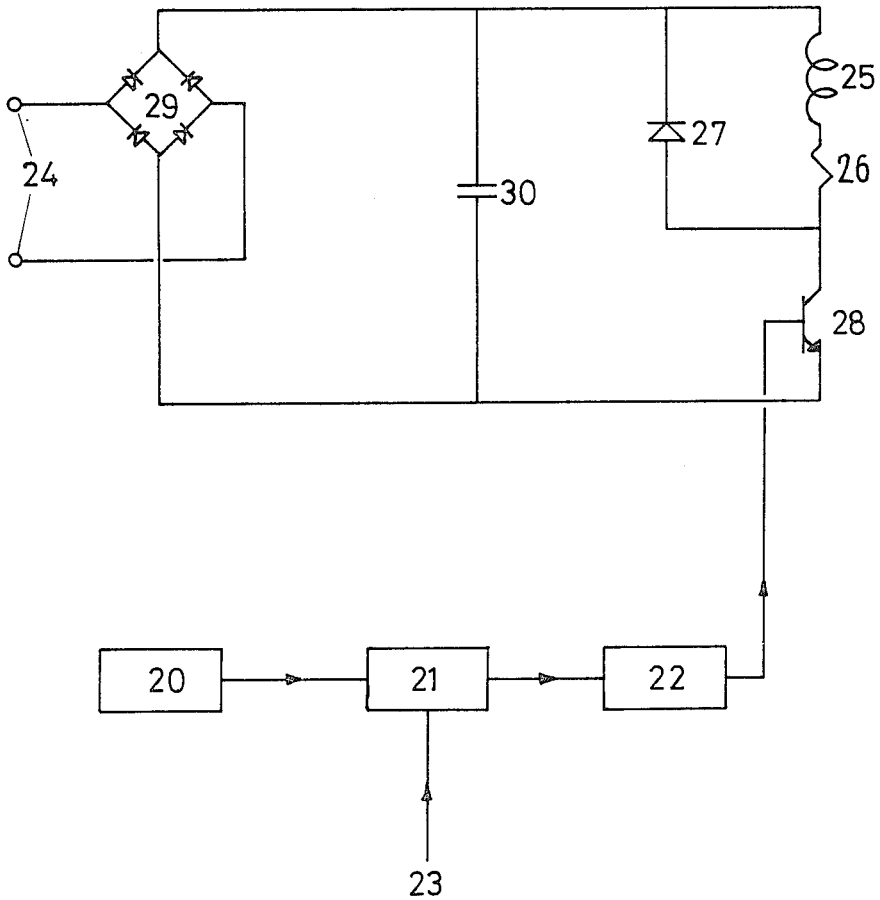
FIG. 4 represents a preferred circuit.

A preferred electronic circuit is shown in FIG. 4 which is a schematic diagram of the special circuit. The circuit enables current transformation between the supply at 24 on FIG. 4 and the helical wire heating element whose inductive and resistive components are shown as 25 and 26 on FIG. 4; i.e., the root mean square (r.m.s.) current through the kiln is greater than the r.m.s. current supplied at terminals 24. The voltage is correspondingly reduced.

Although it may not be generally recognized that the circuit of FIG. 4 will enable current transformation, it is well known among electrical engineers as a means of controlling electric motors.

Bridge rectifier 29 represents an unregulated power supply whose terminals of opposite polarity are connected to capacitor 30.

Although 25 and 26 are described above as being the electrical components of the helical wire heating element, it is not essential to the definition of the special circuit that this be so. Resistance 26 may represent the electrical resistance of the heating element whose configuration is such as to have insufficient inductance. Component 25, generally defined here as the series inductance of the special circuit, in this case would be provided by a separate inductor having appropriate inductance.

Since the effective transformer ratio for the special circuit may be easily varied, it provides a means for controlling the power to the kiln in a continuously varying manner as well as effecting a match for maximum permissible current from the power source under conditions of varying supply voltage and element resistance.

The circuit operates as follows: sub-circuit 20 is a pulse generator of frequency about 10 kHz. Sub-circuit 21 operates on the pulse train to vary the duty cycle or mark-space ratio in accordance with the power requirements of the kiln. Input 23 represents the source of the signal which dictates power requirements, e.g., a manual control or a thermostatic circuit and device. Both sub-circuits 20 and 21 consume very little power and most conveniently comprise standard integrated circuit components. Sub-circuit 22 is a means of enhancing the power level of the pulse train from sub-circuit 21 sufficiently for driving switching power transistor 28. This is most conveniently a bipolar or field effect power transistor. It may be replaced by two or more transistors. Transistor 28 is thus switched repeatedly between on and off at a controllable duty cycle. (The duty cycle is defined as the time transistor 28 is switched on expressed as a fraction or percentage of the period of the switching cycle).

Alternating current is supplied from the mains at terminals 24 and is rectified to direct current by the bridge rectifier 29. Essentially this current flows relatively steadily into capacitor 30. If the duty cycle is set at 50%, for example, current will flow out of capacitor 30 in bursts of twice the steady input current to capacitor 30. These bursts will travel through inductance 25, resistance 26 and transistor 28. However while transistor 28 is switched off, the level of the burst of current will be maintained through inductance 25 and resistance 26 this time via the diode 27. The inductance 25 is essential for maintaining this current and there is a known relationship between the values of inductance 25, resistance 26 and the pulse frequency which must be satisfied for correct operation. Thus, in our example, the kiln current will be essentially steady at twice the current supplied from the mains. In general the transformer ratio is the inverse of the duty cycle D and the current supplied from the mains $i_s$ is given by $$i_s = D^2 V_s / R_1$$

where $V_s$ is the voltage of the supply mains and $R_1$ is the resistance of 26.

The above description of this invention in terms of a cylindrical top-loading kiln and helical wire heating element is not intended to exclude other types of loading, kiln shape or heating element construction or shape. For example, after the sub-assembly comprising pillars 12 and the heating element is made, the wire may then be bent so as to assume a rectangular shape suitable for fitting into an appropriately sized rectangular top-loading kiln. A further adaptation is a helical heating element fitted without alteration into a polygonal shaped kiln.

Again the invention applies equally well to a kiln with an access door (side loading) fitted with a heating element having a horizontal axis.

Other methods of supporting the wire free from the walls of the kiln are not excluded from this invention provided they restrict the position of the wire as described herein with regared to spacing of the turns and allowances for changes in the dimensions of the wire. Pillars are not essential to this invention. Nor is it essential that the method of construction be by threading a wire helix through a series of elongated holes. The invention includes, for example, support by means of U-shaped staples driven into the wall of the kiln after insertion of the helix into the kiln. In this case each staple is placed so as to capture and locate part of a single turn of the helix and is driven to a depth which allows the specified change in dimension of the wire to occur without interference.

The kiln is usually of circular cross-section i.e. cylindrical in shape in which case the wire may closely follow the contour of the inside surface of the walls of the kiln. It is intended that the cross-section of the kiln be not limited to any particular shape. Apart from a circular cross-section desirably it is square or hexagonal. If there are more than six sides for reasons of convenience and economy the turns need not follow the contour of the wall surface exactly.

It is emphasized that the foregoing description of the preferred embodiments is illustrative rather than restrictive.

I claim:

1. An electric kiln comprising:

a frame including a removable door frame element and means for locating said door frame element within said frame;

a heating chamber contained and supported by said frame, said heating chamber being constructed of thermal insulation part of whose internal wall surface approximates the surface of a cylinder part of said heating chamber being contained and supported by said door frame element to form a removable access door;

a plurality of pillars made of electrically insulating material and disposed about the inner surface of said heating chamber, said pillars having elongated holes through which the wire of a heating element passes;

an electric heating element formed from a continuous length of unspiralled wire, said element comprising two relatively short terminal sections and a helical section shaped in the form of a helix of helix diameter slightly less than the diameter of the cylindrical wall surface of the heating chamber, said helical section being supported free from said cylindrical wall surface by said pillars, said pillars and wire thereby forming a sub-assembly which is fitted as a unit within the wall of the heating chamber, said sub-assembly being constructed by screwing a wire helix into said pillars while said pillars are located temporarily in a jig, the thickness of said wire being sufficiently large as to enable the curvature of each turn of said wire helix to be substantially retained when stressed to levels up to the elastic limit of the material of the wire at ambient temperature by application of perturbing forces; and means for controlling the electric power applied to said heating element.

2. A kiln as claimed in claim 1 in which the frame is metal and includes a cylindrical container and wherein the thermal insulation is a ceramic wool.

3. A kiln as claimed in claim 1 in which the control of the electric power is accomplished by a special electronic circuit comprising:

a power supply having first and second terminals of opposite polarity;

a capacitor connected between said first and second terminals;

a first series combination of a diode and switching transistor connected between said first and second terminals, said first series combination comprising a transistor whose emitter is connected to said second terminal and whose collector is connected to said diode, the conducting directions of said transistor and diode in relation to a direction through said first series combination being opposite;

a generator of electric pulses whose output is connected to an electronic means of varying the duty cycle of said pulses in accordance with an external control signal to form a train of control pulses, the output of said means of varying the duty cycle being connected to the gate of said transistor via circuitry which causes the transistor to switch on and off synchronously with the succession of hi and lo states of said control pulses;

load terminals for connection of the heating element of the kiln, said load terminals being connected respectively to terminals of said diode.

4. A kiln as claimed in claim 2 in which the control of the electric power is accomplished by a special electronic circuit comprising:

an unregulated power supply having first and second terminals of opposite polarity;

a capacitor connected between said first and second terminals;

a first series combination of a diode and switching transistor connected between said first and second terminals, said first series combination comprising a transistor whose emitter is connected to said second terminal and whose collector is connected to said diode, the other terminal of said diode being connected to said first terminal, the forward direction of said diode being from said collector to said first terminal;

a generator of electric pulses whose output is connected to an electronic means of varying the duty cycle of said pulses in accordance with an external control signal to form a train of control pulses, the output of said means of varying the duty cycle being connected to the base of said transistor via circuitry which causes the transistor to switch on and off synchronously with the succession of hi and lo states of said control pulses;

load terminals for connection of the heating element of the kiln, said load terminals being connected respectively to terminals of said diode.

5. A kiln as claimed in claim 3 wherein the load terminals are connected to a series combination of said heating element and an inductor.

6. A kiln as claimed in claim 4 wherein the load terminals are connected to a series combination of said heating element and an inductor.

7. A kiln as claimed in claim 1 the cylindrical axis of which is vertical and wherein said access door is disc-shaped and located at the top of the heating chamber to allow top loading of the kiln, said heating chamber having a cylindrical internal insulated wall and a flat insulated base and wherein said pillars stand vertically.

8. A kiln as claimed in claim 6 the cylindrical axis of which is vertical and wherein said access door is disc-shaped and located at the top of the heating chamber to allow top loading of the kiln, said heating chamber having a cylindrical internal insulated wall and a flat insulated base and wherein said pillars stand vertically.

* * * * *